US008408972B2

(12) United States Patent
Kenney

(10) Patent No.: US 8,408,972 B2
(45) Date of Patent: Apr. 2, 2013

(54) APPARATUS AND METHOD FOR INTRICATE CUTS

(75) Inventor: Kevin M. Kenney, San Jose, CA (US)

(73) Assignee: Apple Inc., Cupertino, CA (US)

( * ) Notice: Subject to any disclaimer, the term of this patent is extended or adjusted under 35 U.S.C. 154(b) by 450 days.

(21) Appl. No.: 12/692,837

(22) Filed: Jan. 25, 2010

(65) Prior Publication Data

US 2011/0183580 A1 Jul. 28, 2011

(51) Int. Cl.
*B24B 1/00* (2006.01)

(52) U.S. Cl. ..... 451/54; 451/28; 451/69; 451/70

(58) Field of Classification Search ..... 451/58, 451/57, 69, 70, 37, 51, 61, 164, 165, 162; 409/244, 259; 29/557
See application file for complete search history.

(56) References Cited

U.S. PATENT DOCUMENTS

| | | | | |
|---|---|---|---|---|
| 1,775,813 | A * | 9/1930 | Colby | 30/317 |
| 1,957,156 | A * | 5/1934 | Barth et al. | 83/786 |
| 2,050,901 | A * | 8/1936 | Sundell | 409/279 |
| 2,638,523 | A | 5/1953 | Rubin | |
| 2,834,158 | A * | 5/1958 | Petermann | 451/28 |
| 2,990,616 | A * | 7/1961 | Kuris et al. | 433/119 |
| 3,131,515 | A * | 5/1964 | Mason | 451/28 |
| 3,535,955 | A * | 10/1970 | Otto et al. | 76/107.8 |
| 3,802,040 | A * | 4/1974 | Nomamoto | 29/90.01 |
| 3,814,016 | A | 6/1974 | Leach et al. | |
| 4,439,298 | A | 3/1984 | Ford et al. | |
| 4,467,168 | A * | 8/1984 | Morgan et al. | 219/121.67 |
| 4,934,103 | A * | 6/1990 | Campergue et al. | 451/165 |
| 4,988,550 | A | 1/1991 | Keyser et al. | |
| 5,052,153 | A * | 10/1991 | Wiand | 451/70 |
| 5,101,599 | A * | 4/1992 | Takabayasi et al. | 451/165 |
| 5,111,579 | A | 5/1992 | Andersent | |
| 5,116,138 | A | 5/1992 | Macsenti et al. | |
| 5,140,773 | A * | 8/1992 | Miwa et al. | 451/41 |
| 5,237,788 | A | 8/1993 | Sandow | |
| 5,249,534 | A | 10/1993 | Sacks | |
| 5,395,682 | A | 3/1995 | Holland et al. | |
| 5,439,330 | A * | 8/1995 | Bayer et al. | 408/1 R |
| 5,503,506 | A | 4/1996 | Yuan | |
| 5,619,889 | A * | 4/1997 | Jones et al. | 76/104.1 |
| 5,755,539 | A * | 5/1998 | Takeuchi et al. | 409/275 |
| 5,865,569 | A | 2/1999 | Holstein et al. | |
| 5,967,357 | A | 10/1999 | Kellogg et al. | |
| 5,984,600 | A * | 11/1999 | Gierth | 409/269 |
| 6,193,089 | B1 | 2/2001 | Yu | |
| 6,267,036 | B1 * | 7/2001 | Lani | 83/660 |
| 6,276,100 | B1 | 8/2001 | Woll et al. | |
| 6,435,363 | B2 | 8/2002 | Fingerhut et al. | |

(Continued)

FOREIGN PATENT DOCUMENTS

| | | |
|---|---|---|
| EP | 1139638 | 10/2001 |
| EP | 2051572 | 4/2009 |

(Continued)

*Primary Examiner* — George Nguyen
(74) *Attorney, Agent, or Firm* — Dorsey & Whitney LLP

(57) ABSTRACT

Certain embodiments disclosed herein relate to apparatuses and methods for intricate cuts. In particular, in one embodiment, a cutting apparatus is provided. The cutting apparatus includes a base member and an elongate member extending from the base member. The elongate member includes a tapered region having an abrasive surface. The tapered region defines at least one vertex defining an angle of a desired cutout shape. Additionally, the tapered region is toothless.

23 Claims, 9 Drawing Sheets

U.S. PATENT DOCUMENTS

| | | | | |
|---|---|---|---|---|
| 6,437,238 | B1 | 8/2002 | Annerino et al. | |
| 6,689,246 | B2 | 2/2004 | Hirahara et al. | |
| 6,775,908 | B2 * | 8/2004 | Ohara et al. | 29/888.1 |
| 6,846,221 | B2 * | 1/2005 | Ulrich et al. | 451/2 |
| 6,973,815 | B2 * | 12/2005 | Bryans et al. | 72/340 |
| 7,063,763 | B2 | 6/2006 | Chapman, Jr. | |
| 7,068,343 | B2 | 6/2006 | Saitoh | |
| 7,115,323 | B2 | 10/2006 | Westre et al. | |
| 7,191,555 | B2 | 3/2007 | Hughes | |
| 7,326,012 | B2 * | 2/2008 | Schlotter | 409/259 |
| 7,338,235 | B2 | 3/2008 | Weghaus et al. | |
| 7,436,653 | B2 | 10/2008 | Yang et al. | |
| 7,527,321 | B1 | 5/2009 | Benderoth et al. | |
| 7,545,628 | B2 | 6/2009 | Takuma | |
| 7,571,828 | B2 | 8/2009 | Palley et al. | |
| 7,588,970 | B2 | 9/2009 | Ohnuma | |
| 7,628,879 | B2 | 12/2009 | Ackerman | |
| 7,762,028 | B2 | 7/2010 | Valentz et al. | |
| 7,790,637 | B2 | 9/2010 | DiFonzo et al. | |
| 7,934,676 | B2 | 5/2011 | Dufresne et al. | |
| 7,963,483 | B2 | 6/2011 | Roming et al. | |
| 7,971,400 | B2 | 7/2011 | Boldt et al. | |
| 7,988,532 | B2 * | 8/2011 | Choo et al. | 451/10 |
| 8,042,770 | B2 | 10/2011 | Martin et al. | |
| 2005/0097717 | A1 * | 5/2005 | Rasmussen | 29/26 A |
| 2006/0005374 | A1 * | 1/2006 | Glimpel | 29/557 |
| 2006/0223427 | A1 * | 10/2006 | Tsumuraya et al. | 451/61 |
| 2008/0094372 | A1 | 4/2008 | Philipp | |
| 2008/0169380 | A1 | 7/2008 | Jackson et al. | |
| 2008/0259537 | A1 | 10/2008 | Arisaka et al. | |
| 2009/0040703 | A1 | 2/2009 | Gotham et al. | |
| 2009/0095523 | A1 | 4/2009 | Stevenson et al. | |
| 2009/0142157 | A1 | 6/2009 | Wang et al. | |
| 2009/0267266 | A1 | 10/2009 | Lee et al. | |
| 2010/0078254 | A1 | 4/2010 | Rolfe et al. | |
| 2010/0159812 | A1 * | 6/2010 | Schimweg | 451/546 |
| 2010/0289390 | A1 | 11/2010 | Kenney | |
| 2011/0180557 | A1 | 7/2011 | Kenney | |
| 2011/0290685 | A1 | 12/2011 | Kenney | |
| 2012/0021196 | A1 | 1/2012 | Kenney | |

FOREIGN PATENT DOCUMENTS

| | | |
|---|---|---|
| JP | 2006123475 | 5/2006 |
| JP | 2007076202 | 3/2007 |
| WO | WO98/15404 | 4/1998 |
| WO | WO2008/133748 | 11/2008 |
| WO | WO2009/017571 | 5/2009 |

* cited by examiner

APPARATUS AND METHOD FOR INTRICATE CUTS

BACKGROUND

1. Technical Field

Embodiments described herein relate generally to apparatuses and methods for intricate cuts and, more specifically, to creating sharp features in cutouts.

2. Background

Various techniques have been employed to generate precision cuts in materials used in consumer goods. As may be expected, certain techniques are better suited for certain materials and/or for certain types of cuts. Machining, for example, may not be desirable for forming intricate cuts with sharp and/or acutely angled features. In particular, sharp features forming an apex of an angle cannot be easily produced with a rotary cutter. Generally, these sharp features are approximated by using cutters having increasingly smaller diameters. However, as the size of the cutter decreases, the machining cycle time (and cost) is greatly increased, making the process economically infeasible for large-scale production of consumer goods. Additionally, other techniques such as computer numerical control (CNC) milling, water jet cutting, laser cutting, and so forth, may not provide adequately sharp features at a reasonable cost and may thus be unacceptable.

Stamping, punching, or fine-blanking processes may be used to produce intricate cuts in metal. However, such techniques may not produce satisfactory results for carbon fiber reinforced plastic (CFRP) panels or other fiber-in-matrix materials, as the CFRP typically does not shear cleanly, resulting in a rough edge with exposed fibers and a generally unacceptable appearance.

SUMMARY

Certain aspects of embodiments disclosed herein are summarized below. It should be understood that these aspects are presented merely to provide the reader with a brief summary of certain forms an invention disclosed and/or claimed herein might take and that these aspects are not intended to limit the scope of any invention disclosed and/or claimed herein. Indeed, any embodiment disclosed and/or claimed herein may encompass a variety of aspects that may not be set forth below.

In one embodiment, a cutting apparatus is provided. The cutting apparatus includes a base member and an elongate member extending from the base member. The elongate member includes a tapered region having an abrasive surface. The tapered region defines at least one vertex defining an angle of a desired cutout shape. Additionally, the tapered region is toothless.

In another embodiment, a method of machining intricate cuts in a work piece is provided. The method includes cutting a work piece to form an aperture approximating a desired shape having at least one acute angle. Each acute angle of the desired shape is approximated by a cut having a corner radius. A tapered elongate member of a first cutting apparatus is inserted into the aperture and pushed through the aperture to remove material from the work piece, thereby forming the desired shape having at least one acute angle.

In yet another embodiment, a system for making intricate cuts is provided. The system includes a plurality of cutting apparatuses. Each of the plurality of cutting apparatuses includes a base and a tapered elongate member extending from the base. At least one tapered elongate member includes an abrasive surface. The tapered elongate members having a radial shape with at least one sharp feature. The plurality of cutting apparatuses are sequentially inserted through an aperture in a fiber-in-matrix material to incrementally increase the size of the aperture to form the radial shape having at least one sharp feature of the tapered elongate members.

DETAILED DESCRIPTION

Figure 1:
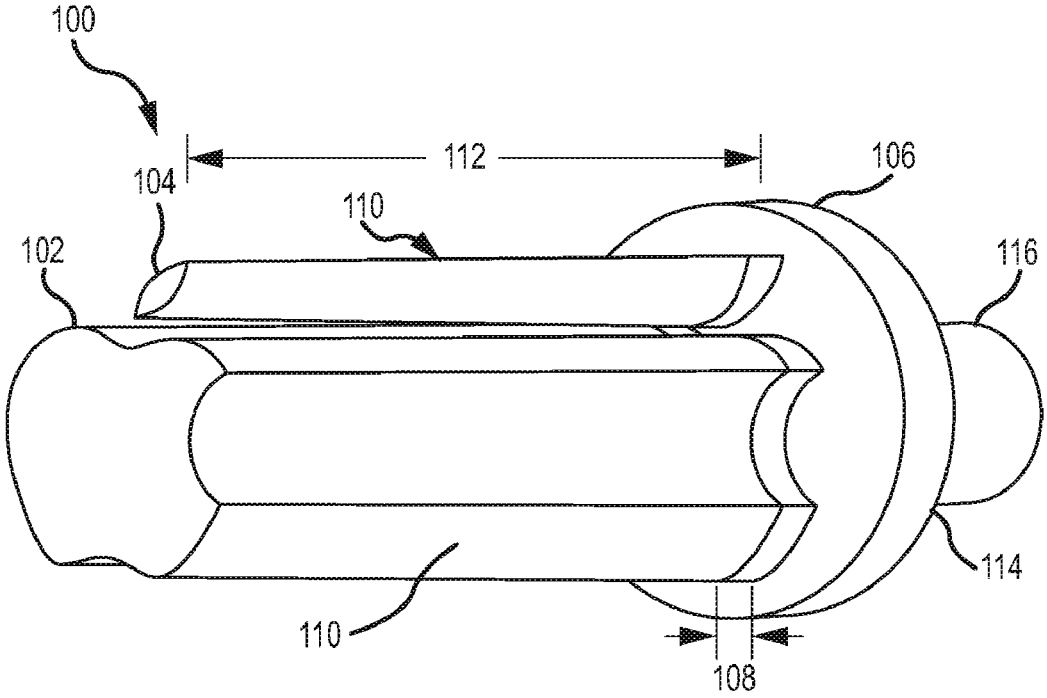
FIG. 1 illustrates an example cutting tool for making intricate cuts.

Certain aspects of the present disclosure relate to apparatuses and methods for creating intricate cuts such as a logo, trademark, letter, or symbol, in materials such as plastics, metals, carbon fiber reinforced plastic (CFRP), other fiber-in-matrix materials, or other composite materials. The material may be used in consumer electronic products as a housing surface, among other things. In some embodiments, an aperture is made in the material employing a conventional machining or milling technique and tools, such as a computer numerical controlled (CNC) milling technique. The aperture may take a general shape of a desired intricate cut For example, when the ultimately desired shape is an apple, the general shape created by CNC milling may be a circle or oval. Often, the aperture may be a circle, a square or other geometric shape.

A tapered shaft having an abrasive surface is inserted into the aperture. The cross-section of the shaft is the shape of the desired intricate cut. The shaft gradually expands radially (i.e., gets bigger) along the length of the shaft. As the shaft increases in size, the cross-section shape stays the same. That is, the shape of the shaft remains the same along the length of the shaft as the cross-sectional size of the shaft increases due to the taper. The tapered shaft is toothless. That is, the tapered region does not include teeth, in contrast to conventional broach tools, for cutting through material.

In some embodiments, the tapered shaft may have a terminal end having a squared tip or a spherical shape. Additionally, the taped shaft may abut a non-tapered region. The tapered shaft is pushed through the aperture. As the tapered shaft is pushed through the aperture, material is removed to create intricate cuts. Upon removal of the tapered shaft from the aperture, the desired shape having sharp features is revealed in the material.

As used herein, the term "sharp feature" may refer to features defined by a vertex of an angle. Likewise, the term may refer to features that form either an internal or external point in a cutout. In some embodiments, the sharp features may require intricate cuts that are difficult to create in certain materials using conventional tools and techniques.

In some embodiments, multiple tapered shafts may be implemented. For example, in some embodiments, multiple tapered shafts may be employed, each having a different tapering angle. A tapered shaft having the steepest taper may be used first and a tapered shaft with the least taper may be used last when creating cutouts or removing material. Additionally or alternatively, in some embodiments, multiple tapered shafts having coarser and finer abrasive surfaces may be implemented with the shaft having the finest abrasive surface being used last when creating cutouts or removing material. Additionally or alternatively, multiple shafts having different lengths may be employed in a sequential process to achieve the desired sharp features.

Moreover, in some embodiments the tapered shaft and/or the material in which the intricate cuts are to be made may be mounted on a device to facilitate the cut or to achieve a desired result with the cut. For example, in some embodiments, the tapered shaft may be mounted on a reciprocating device that is used to gradually move the tapered shaft through the material, thereby cutting the material. In another embodiment, the tapered shaft and/or the material in which the cut is to be made may be mounted on an ultrasonic device and an abrasive slurry may be provided at the site of the cut. As the ultrasonic device vibrates the material, the tapered shaft gradually cuts into the material surface and eventually therethrough.

The use of the tapered, abrasive shaft to create intricate cuts having sharp features in materials such as CFRP helps provide a cut having a nice finish in timely and cost efficient manner. Because the shaft is toothless, fiber-in-matrix materials may be cut without causing tearing of the fibers. Additionally, the sharp features may be achieved with a high degree of precision as compared to conventional milling techniques, thus providing a more aesthetically pleasing appearance.

Turning now to the drawings and referring to FIG. 1, a cutting tool 100 for making sharp features of a cutout is illustrated. The cutting tool 100 may be made of any suitable material having high strength such as hardened steel, steel alloyed with tungsten, chromium and/or vanadium, carbides, and so forth. The cutting tool may be created through an electrical discharge machining (EDM) process or similar process. Generally, in the EDM process, material is removed from a work piece by a series of current discharges between two electrodes to form the work piece into a desired shape. Other processes may be employed in addition to or instead of the EDM process to create the cutting tool 100. For example, after the desired shape has been created via the EDM process, some fine machining or polishing may be performed to achieve a precise shape for the cutting tool 100.

The cutting tool 100 includes one or more elongate members 102, 104 that extend from a base 106. In cross-section, the elongate members 102, 104 have the form of a desired shape that is to be cut into a material. In some embodiments, the desired shape may be a design, a logo, a trademark, a symbol, a letter, a word or numbers, for example. The size of the elongate member 102, 104 at the base 106 defines the size of the cutout that the cutting tool 100 makes. The elongate members 102, 104 typically taper from the base 106 towards the tip.

In some embodiments, the elongate members 102, 104 may include a non-tapered region 108 that abuts the base 106. As the non-tapered region 108 abuts the base 106, the non-tapered region 108 corresponds in size to the size of the cutout that the cutting tool 100 makes.

The surfaces 110 that extend axially along the length of the elongate members 102, 104 function as the cutting surfaces of the cutting tool 100 and, as such, may have an abrasive coating. In some embodiments, the abrasive coating may be a diamond coating, a silicon coating, a carbonate coating, a tungsten coating, and so on. The coating may be applied to the elongate members 102, 104 in any suitable manner and in accordance with known techniques.

In some embodiments, a tapered region 112 of the elongate members 102, 104 may have a different coating or surface than the non-tapered region. For example, the tapered region 112 may have a diamond coating while a lapping compound is applied to the non-tapered region 108. In other embodiments, a lapping compound may be applied to the tapered region 112 and not to the non-tapered region 108.

The base 106 may have a planar surface 114 that is perpendicular to the axis of the elongate members 102, 104. The planar surface 114 may serve as an end-stop for the cutting tool 100. That is, the planar surface may stop the cutting tool 100 from continuing to move through a cutout. Additionally, the base 106 may have a coupling member 116 to allow the cutting tool 100 to be coupled to machinery to drive or otherwise operate the tool. For example, the coupling member 116 may allow for the cutting tool to be mounted on a reciprocating device, an ultrasonic device, or other device that may aid in use of the cutting tool 100.

Figure 2:
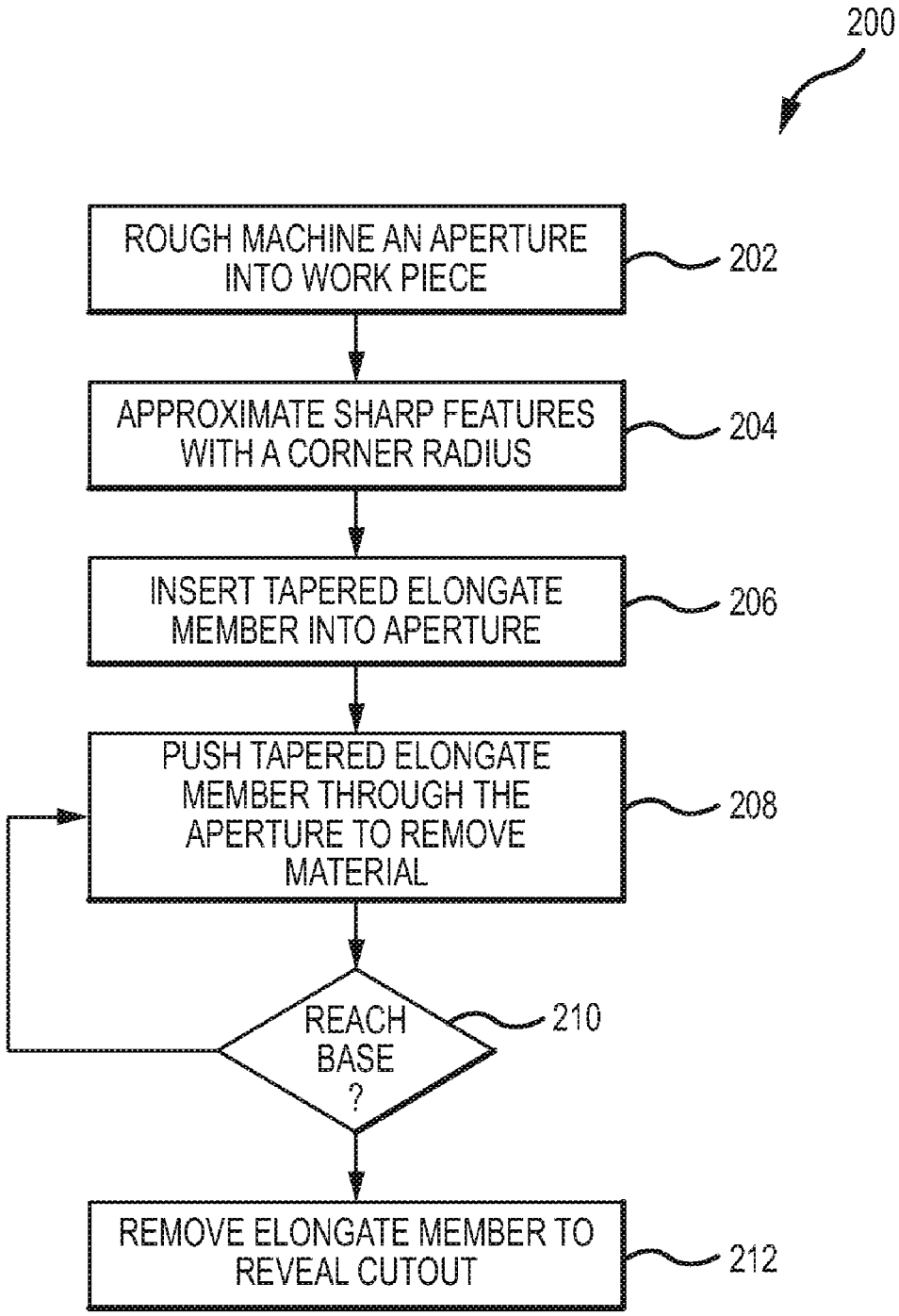
FIG. 2 is a flowchart illustrating example methods of making intricate cuts.

Referring to FIG. 2, a flowchart 200 illustrating a method for making a cut in a work piece is illustrated. The work piece may be any material in which a cutout is to be made and may be formed of a composite material such as CFRP, a plastic, a metal and so on. Initially, an aperture is rough machined into the work piece (Block 202). The rough machining may be performed through a suitable milling or machining process including computer numerical controlled (CNC) milling. The aperture made in the work piece may take the general shape of a desired cutout. Generally, the aperture is smaller than the desired cutout, but large enough to allow entry of the cutting tool into the aperture. Sharp features, such as apexes for angles, may be approximated in the rough machining with a corner radius (Block 204).

In one embodiment, the tapered elongate members 102, 104 are inserted into the aperture (Block 206) and then pushed through the aperture to remove material from the work piece (Block 208). The elongate members 102, 104 may be pushed through the aperture in a single linear stroke by a machining device to which the cutting tool 100 is mounted. As the elongate members 102, 104 are pushed through the aperture, the elongate members 102, 104 self-center within the aperture and material may be removed from the corner radii that that approximate the sharp features.

In some embodiments, the method for making intricate cuts may include the use of additional machinery, such as an ultrasonic device or a reciprocating device. In particular, in some embodiments, the cutting tool 100 or the work piece may be mounted on an ultrasonic device to aid in pushing the cutting tool through the aperture. An abrasive slurry, such as a lapping compound, may be provided for use with the ultrasonic device. As the ultrasonic device is operated, the abrasive slurry wears away the material where the cutting tool is located (i.e., in the aperture).

In the ultrasonic machining process, a low-frequency electrical signal is applied to a transducer, which converts the electrical energy into high-frequency (~20 KHz) mechanical vibration. This mechanical energy is transmitted to a tool assembly and results in a unidirectional vibration of the tool 100 at the ultrasonic frequency with a known amplitude. Typical amplitudes are in the range of 10-50 μM. The ultrasonic device will result in much more cutting action as the tool will reciprocate at a small amplitude but very high frequency.

In another embodiment, the cutting tool 100 may be mounted on a reciprocating device. The reciprocating device may move with a small displacement and a high speed stroke. The stoke is in the same direction as the feed of the elongate members 102, 104 into the aperture (i.e., perpendicular to the work piece). The use of the reciprocating member or the ultrasonic device may reduce the speed at which material is removed from the work piece, thus resulting in longer cut times. However, their use may also result in a superior surface finish.

As the tapered elongate members 102, 104 are pushed through the aperture, it is determined if the base 106 has been reached (Block 210). If the base has not been reached, the tapered elongate members 102, 104 continue to push through the aperture (Block 208). Upon reaching the base 106, the elongate members 102, 104 are removed to reveal the cutout (Block 212).

The determination as to whether the base 106 has been reached may be performed in any of a number of ways. For example, in some embodiments, the determination as to when the base has been reached may be made through user observation of the machining device used to push the cutting tool through the aperture. In other embodiments, a machining device to which the cutting tool is mounted may measure the displacement distance of the cutting tool and a processor, software or hardware may be configured to determine when a threshold distance has been exceeded. That is, upon achieving a known (threshold) distance, the machine may determine that the cutting device has passed through the material and the base has been reached.

In some embodiments, the machining device may be configured with a processor, software, and/or hardware configured to determine when the base is reached based on an amount of pressure applied for displacement of the cutting tool. For example, in one embodiment, if the cutting tool has a non-tapered portion, the amount of pressure required to displace the cutting tool will be expected to decrease when the non-tapered region of the tool is passing through the aperture, as it will not be making as significant cut (if any) relative to the tapered region. In another embodiment, when the base 106 is pressing against the material, there may be an increase of pressure required to displace the cutting tool (as the base 106 will serve as an end stop and the only movement will result from flexion of the material). As such, the machining device may be configured to apply not more than a threshold amount of pressure to make the cuts. The threshold level of pressure may vary based on the material being cut and the configuration of the cutting tool being used. Generally, the threshold level of pressure will be set to a level that allows for the tapered shaft to cut the material, but at a level less than an amount that may cause excessive flexion of the material when the base is pressing on the material. Additionally, the machining device should have an adjustable stop so the desired stroke of the tool cannot be exceeded.

The back side of the material that is to be cut should be supported by a rigid platform with a cavity approximately the size of the final machined feature but slightly larger to allow for clearance between the rigid platform and the tool. The clearance should be kept to a practical minimum to reduce bending forces on the material as it is machined. In addition it may be desirable to add a similar rigid platform to the front side of the part and clamp both rigid platforms together. This would provide superior results by reducing bending and other unwanted movement of the part during machining.

It should be appreciated that the length of the elongate members 102, 104, the taper angle of the tapered region 112, and the stroke speed will each affect the quality of the machined surface and the particular parameters may be empirically determined for each application. In some embodiments, for example, the length of the elongate members 102, 104 may be longer and have a more gradual taper. The longer length generally also requires a longer stroke. However, in some embodiments, the stroke may be made more quickly.

Figure 3A:
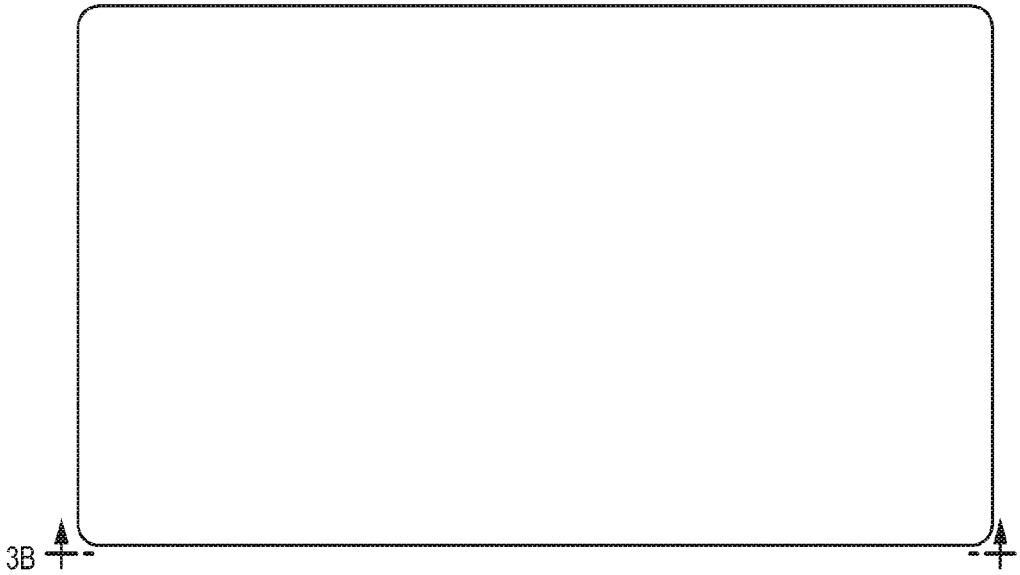
FIGS. 3A and 3B illustrate a top view and side view (respectively) of an example work piece.
Figure 3B:
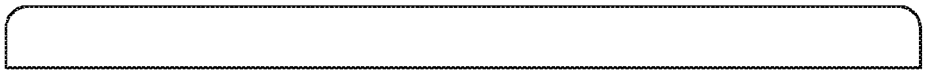

FIGS. 3A and 3B illustrate an example work piece 300 prior to processing the work piece to have a cutout. Specifically, FIG. 3A is a top view and FIG. 3B is a side view of the work piece 300. As mentioned above, the work piece 300 may be a plastic, metal or composite material. In some embodiments, the work piece 300 may be made of one or more layers of one material or layers of different materials. As illustrated the work piece 300 is a panel and may be used as a housing for an electronic device.

Figure 4:
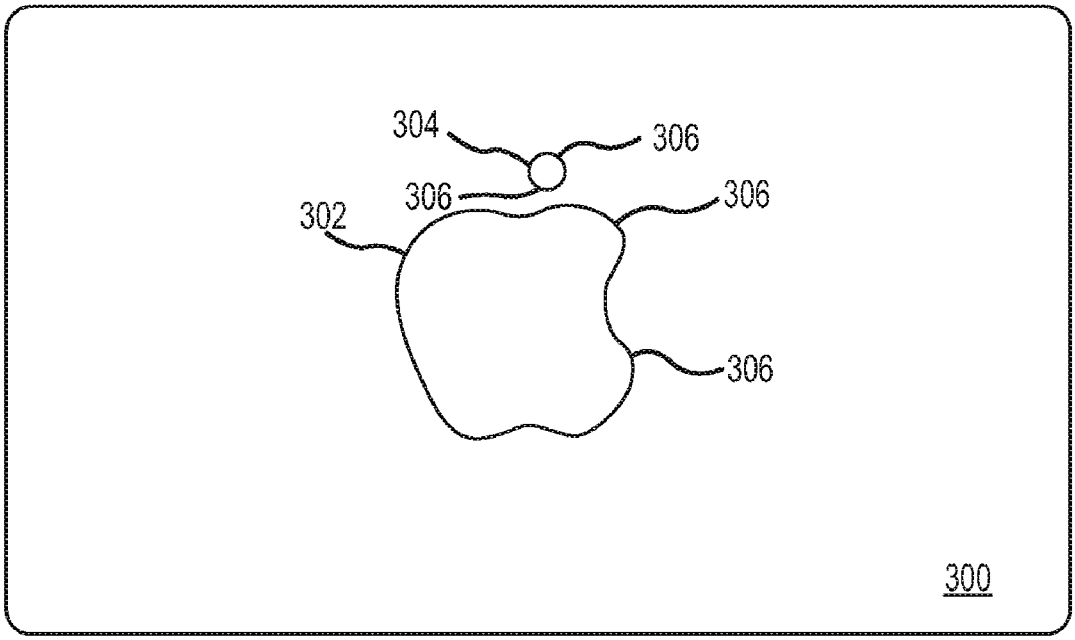
FIG. 4 illustrates the work piece of FIG. 3A after rough machining an aperture into the work piece.

FIG. 4 illustrates the work piece 300 after rough machining. As illustrated, after rough machining, one or more apertures 302, 304 may be made in the work piece 300 that approximate the desired shape. As mentioned above, the rough machining may approximate sharp features with curved radii 306. Other features of the desired shape may be more closely approximated by the rough machining. The apertures 302, 304 are smaller than the desired shape, but large enough to allow for elongate members 102, 104 to be inserted therein It should be appreciated that, in some embodiments, the aperture may have a shape different from the general shape of the desired cutout. For example, the aperture may be circular, square or another geometric shape. As above, the aperture made should be large enough to allow for entry of the cutting tool, yet still smaller than the desired cutout.

Figure 5:
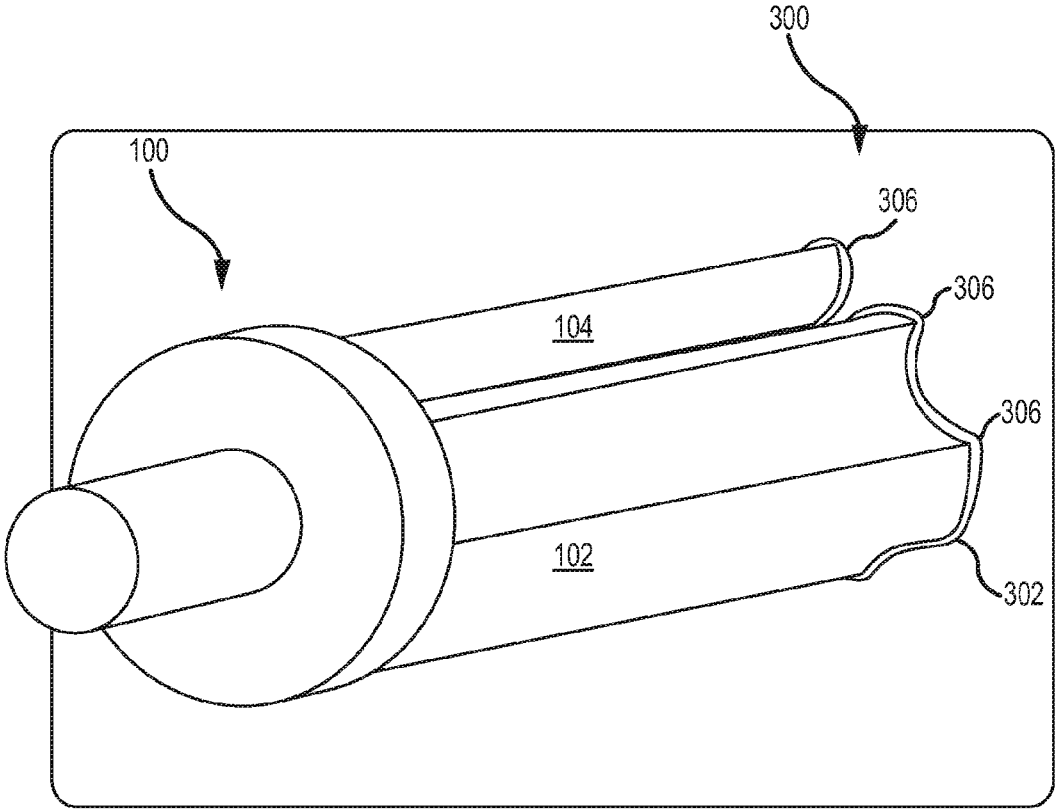
FIG. 5 illustrates the cutting tool of FIG. 1 entering an aperture in the work piece of FIG. 3A.
Figure 6:
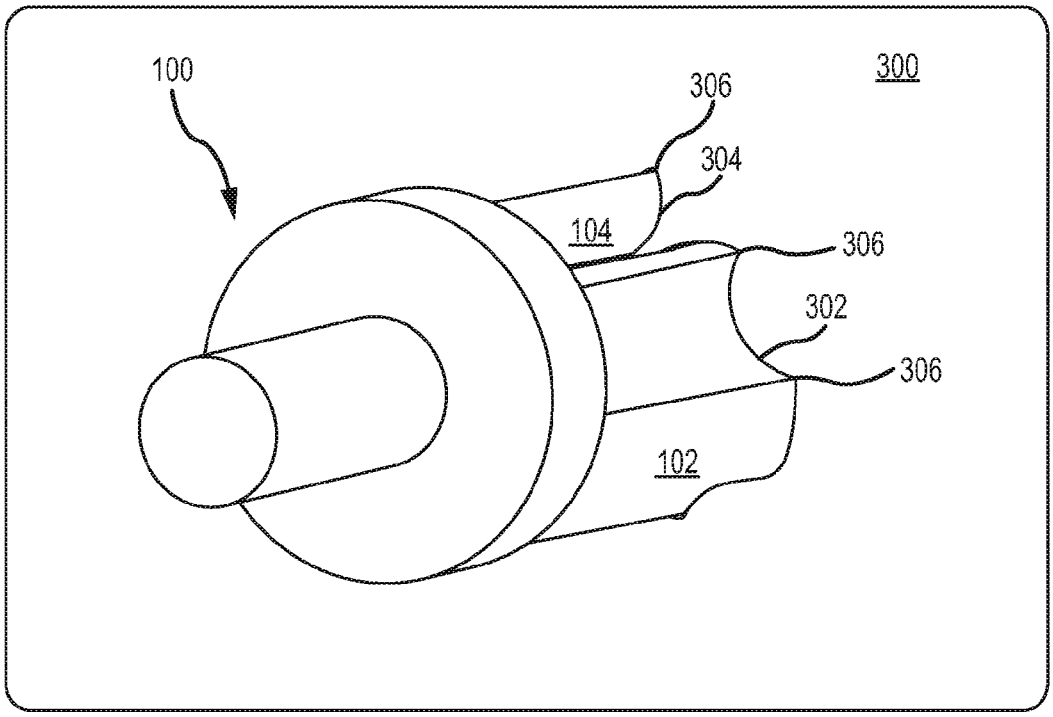
FIG. 6 illustrates the cutting tool of FIG. 1 inserted into an aperture in the work piece of FIG. 3A.

FIG. 5 illustrates the elongate members 102, 104 entering the apertures 302, 304. As illustrated, the apertures 302, 304 provide clearance for leading edges of the elongate members 102, 104. As the elongate members 102, 104 are further inserted into the apertures 302, 304, clearance is diminished and the abrasive surfaces 110 of the elongate members 102, 104 remove material from the work piece 300. FIG. 6 illustrates the elongate members 102, 104 further inserted into the apertures 302, 304 and the abutment of the apertures with the members. As mentioned above, the clearance at the curved radii 306 is reduced first and, as such, these are the first areas where material is removed.

Figure 7:
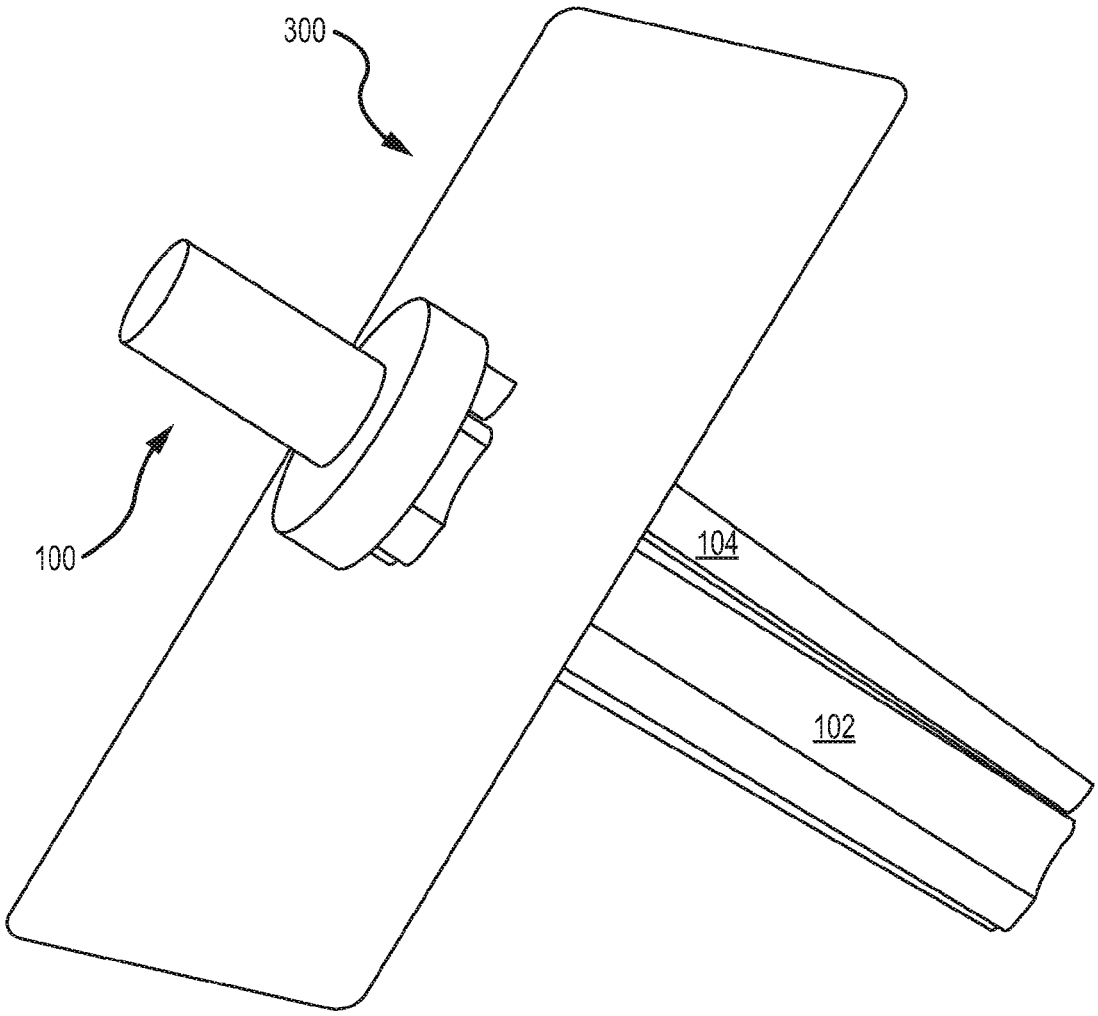
FIG. 7 illustrates the cutting tool of FIG. 1 in full contact with the work piece of FIG. 3A.

FIG. 7 illustrates the surfaces 110 of the elongate members 102, 104 in full contact with the work piece 300. That is, the elongate members 102, 104 have been inserted into the apertures 302, 304 until the surfaces of the elongate members 102, 104 are in full contact with the apertures 302, 304 and making cuts. In some embodiments, this may be achieved at the end of the tapered region 112 (i.e., near the base 106) of the elongate members. In some embodiments, a full stroke may end at the end of the tapered region, which may abut the base 106. In other embodiments, the elongate members 102, 104 may be further pushed into the apertures 302, 304 so that a non-tapered region of the elongate members 102, 104 pass through the apertures and the base 106 and the work piece 300 are in contact.

Figure 8:
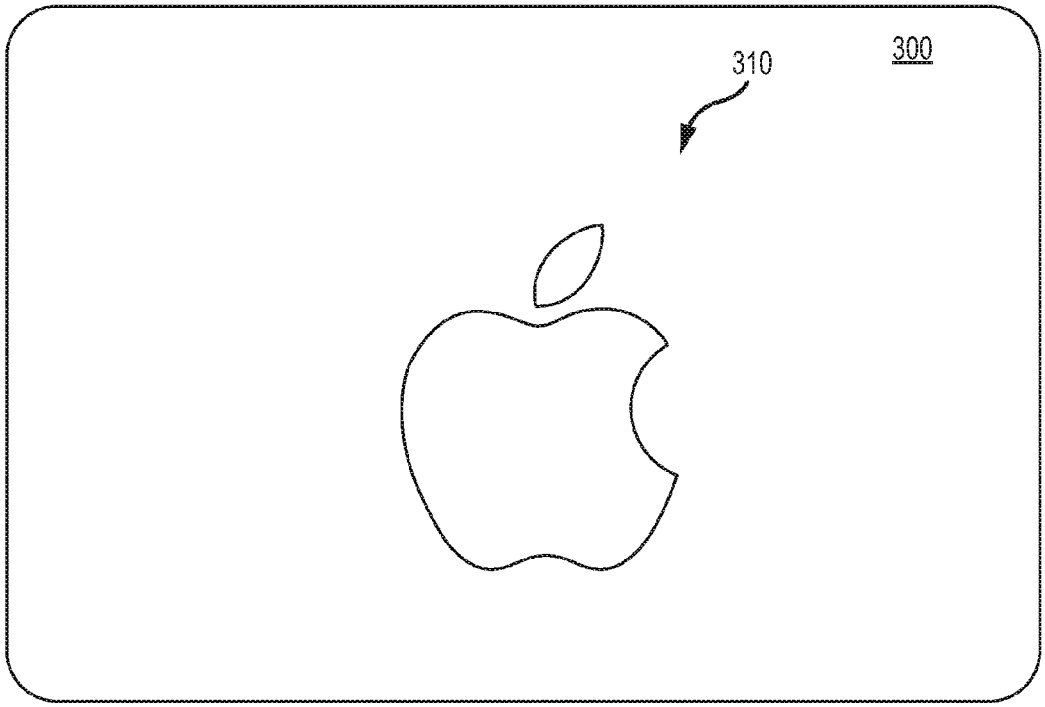
FIG. 8 illustrates the work piece of FIG. 3A after removal of the cutting tool of FIG. 1.

Upon removal of the elongate members 102, 104, the finished shape is revealed, as shown in FIG. 8, and may include certain sharp features 310. The use of the cutting tool 100 in making the intricate cuts greatly reduces the cost of machining intricate cuts in composite materials such as CFRP and, further, improves the quality of the finished product. Indeed, the use of the cutting tool 100 facilitates the machining of sharp features that are not possible using conventional techniques and tools.

In some embodiments, multiple cutting tools may be implemented to create a desired shape having sharp features. Each of the multiple cutting tools may have different characteristics to help facilitate the cutting and/or to provide a better finish or sharper features, among other things. For example, in some embodiments, a first cutting tool may have a steeper taper and subsequent cutting tools may have continually lesser tapers. In some embodiments, a first cutting tool may have larger sized grit than subsequent cutting tools. In some embodiments, the first cutting tool may be longer or shorter than cutting tools used subsequently.

Figure 9A:
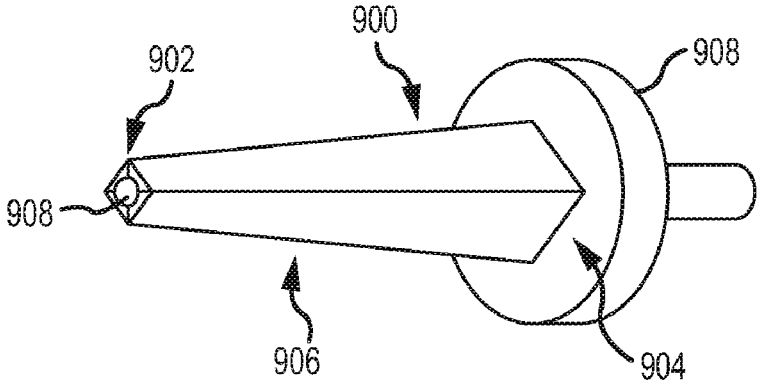
FIGS. 9A-9C illustrate cutting tools in accordance with alternative embodiments.
Figure 9B:
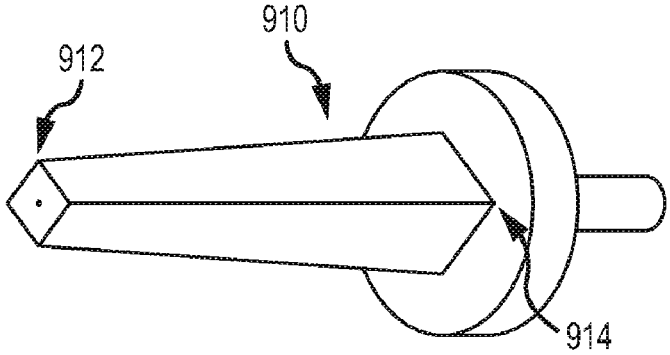
Figure 9C:
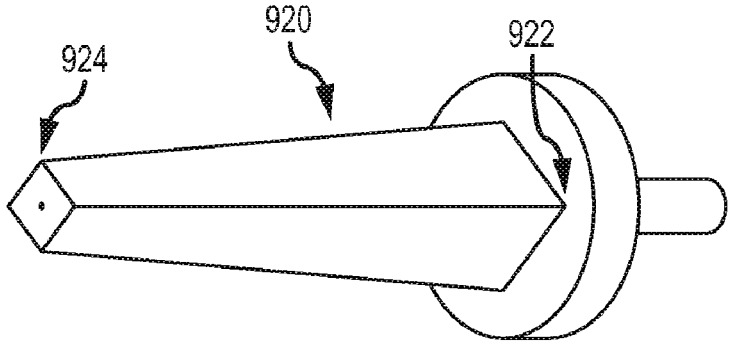

FIGS. 9A-9C illustrate three cutting tools 900, 910, 920 that may be used sequentially to create a cutout having sharp features. The three cutting tools 900, 910, 920 may be used sequentially in a machining process to achieve a desired cutout having sharp features. The use of multiple cutting tools may help provide a gradual and smooth cut for certain materials that may have a tendency to tear or not shear cleanly.

The first cutting tool 900 may be smaller in size than the latter cutting tools 910, 920. Hence, the first cutting tool 900 may have a smaller cross-sectional area relative to the latter cutting tools 910, 920 at both distal and proximal ends 902, 904, respectively, of an elongate member 906. In particular, the cross-sectional area of the tool 900 at its base is slightly larger than the cross-sectional area of the tool 910 at its tip. However, the cross-sectional area of the tool 910 after the tip is larger than the cross-sectional area of the tool 900 at its base. As used herein, the terms "distal" and "proximal" are relative terms to distinguish between ends of an elongate member and are not intended as limiting terms. Generally, a proximal end refers to an end that abuts the base and a distal end refers to an end located away from a base.

The smaller cross-sectional area of the first cutting tool 900 generally removes less material from a work piece than would be removed when using either of tools 910, 920. Additionally, in some embodiments, a terminal end (or tip) 908 of the distal end 902 of the elongate member 906 may have a shape different from the body of the elongate member. For example, the tip 908 may be convex, or have a steeper tapering angle than the body of the elongate member 906. The shape of the tip 908 may aid in insertion of the elongate member 906 into an aperture.

The second cutting tool 910 may generally have a larger cross-sectional area relative to the first cutting tool 900. To allow for ease of entry of the second cutting tool into an aperture made by the first cutting tool 900, the distal end 912 of the second cutting tool 910 is smaller than the proximal end 904 of the first cutting tool 900. The larger cross-sectional area of the second cutting tool 910 provides for a greater amount of material to be removed from a work piece.

The third cutting tool 920 may be have a slightly larger cross-sectional at its proximal end 922 than the proximal end 914 of the second cutting tool 910. The proximal end 922 of the third cutting tool defines the shape and size of the desired cutout. The distal end 924 of the third cutting tool has a cross-sectional area that is smaller than that of the proximal end 914 of the second cutting tool 910. In some embodiments, the distal end 924 of the third cutting tool 920 may be the same size or approximately the same size as the distal end of the second cutting tool 910.

The elongated member 926 of the third cutting member 920 also may be longer than those of the first and second cutting tools 900, 910. An increased length may allow for a more gradual tapering of the elongated member 926 and, hence, a more gradual removal of material from a work piece. Additionally, the third cutting member 920 may have a finer grit coating than the coatings of the first and second cutting tools 900, 910, so that it may provide a smoother finish for the cutout.

It should be appreciated that in other embodiments, the features of the different cutting tools may vary. Additionally, more or fewer cutting tools may be implemented to achieve a particular finish or reduce the amount of time spent processing a work piece. For example, in some embodiments, the second cutting tool 910 may not be used to eliminate a time consuming step.

Additionally, it should be appreciated that in some embodiments, other processing may be provided to achieve a desired result. For example, a lapping process may be provided to further refine the edges of the cutout. In some embodiments, cutting tools may be used in conjunction with the lapping process and a lapping compound to achieve the desired appearance. Additionally or alternatively, a finish tool could be made without abrasive or other cutting provisions and the cutting action would be provided by a mildly abrasive "lapping compound".

Although the present disclosure has been described with respect to particular systems and methods, it should be recognized upon reading this disclosure that certain changes or modifications to the embodiments and/or their operations, as described herein, may be made without departing from the spirit or scope of the invention. Accordingly, the proper scope of the disclosure is defined by the appended claims and the various embodiments, methods and configurations disclosed herein are exemplary rather than limiting in scope.

I claim:

1. A method of machining intricate cuts in a work piece comprising:

cutting a work piece to form an aperture approximating a desired shape having at least one acute angle, wherein each acute angle of the desired shape is approximated by a cut having a corner radius;

inserting a tapered elongate member of a first cutting apparatus into the aperture;

pushing the tapered elongate member through the aperture to remove material from the work piece;

inserting a tapered elongate member of at least one additional cutting apparatus into the aperture; and pushing the tapered elongate member through the aperture to remove material from work piece, thereby forming the desired shape having at least one acute angle.

2. The method of claim 1 further comprising:

mounting the first cutting apparatus to a reciprocating member; and operating the reciprocating member while pushing the tapered elongate member through the aperture.

3. The method of claim 1 further comprising:

sequentially inserting the additional tapered elongate member of the at least one additional cutting member in order of increasingly finer abrasive surfaces to achieve the desired shape; wherein the tapered elongate member of the at least one additional cutting apparatus has a finer abrasive surface than the first cutting apparatus.

4. The method of claim 1 further comprising:

sequentially inserting the one or more additional elongate members having increasingly less taper to achieve the desired shape; wherein the additional tapered elongate member of the at least one additional cutting apparatus tapers less than the first cutting apparatus.

5. The method of claim 1 further comprising:

inserting increasingly shorter cutting apparatuses to achieve the desired shape; wherein the additional tapered elongate member of the at least one additional cutting apparatus has a shorter length than the first cutting apparatus.

6. The method of claim 1 further comprising:

mounting the work piece on an ultrasonic device;

placing the work piece at least partially in an abrasive slurry; and agitating at least one of the work piece and the abrasive slurry with the ultrasonic device.

7. The method of claim 1 further comprising:

mounting the first cutting apparatus on an ultrasonic device;

placing the first cutting apparatus at least partially in an abrasive slurry; and agitating at least one of the first cutting apparatus and the abrasive slurry with the ultrasonic device.

8. The method of claim 1 wherein cutting a work piece to form an aperture comprises using a computer numerical controlled mill.

9. An apparatus for machining intricate cuts in a work piece comprising:

a first member configured to cut a work piece to form an aperture approximating a desired shape having at least one acute angle, wherein each acute angle of the desired shape is approximated by a cut having a corner radius;

a tapered elongate member extending from the first member and configured to be inserted into the aperture, the tapered elongate member having a taper that extends along a length of the tapered elongate member towards a distal end of the tapered elongate member; wherein the tapered elongate is configured to remove material from the work piece, thereby forming the desired shape having at least one acute angle.

10. The apparatus of claim 9, wherein the tapered elongate member comprises a radial shape defining at least one sharp feature.

11. The apparatus of claim 9, wherein:

the tapered elongate member defines a base proximate the first member and an terminal portion spaced apart from the first member by an intermediate section; and at least a portion of the intermediate section of the tapered elongate member tapers at a first angle from the base to the terminal portion.

12. The apparatus of claim 11, further comprising a non-tapered region defined on at least a part of the intermediate section; wherein a cross-section of the non-tapered region corresponds in size with a largest cross-section of the tapered region.

13. The apparatus of claim 11, wherein the terminal portion of the elongate member tapers at a second angle, the second angle steeper than the first angle.

14. The apparatus of claim 11, wherein the terminal portion defines an end having a radial shape comprising at least one vertex.

15. A method of machining intricate cuts in a work piece comprising:

cutting a work piece to form an aperture approximating a desired shape having at least one acute angle, wherein each acute angle of the desired shape is approximated by a cut having a corner radius;

inserting a tapered elongate member of a first cutting apparatus into the aperture, the tapered elongate member having a taper that extends along a length of the tapered elongate member towards a distal end of the tapered elongate member; and pushing the tapered elongate member through the aperture to remove material from the work piece, thereby forming the desired shape having at least one acute angle.

16. The method of claim 15 further comprising:

mounting the first cutting apparatus to a reciprocating member; and operating the reciprocating member while pushing the tapered elongate member through the aperture.

17. The method of claim 15 further comprising:

inserting a tapered elongate member of at least one additional cutting apparatus into the aperture, the tapered elongate member of at least one additional cutting apparatus having a taper that extends along a length of the tapered elongate member towards a distal end of the tapered elongate member; and pushing the tapered elongate member through the aperture to remove material from work piece.

18. The method of claim 15 further comprising:

sequentially inserting the additional tapered elongate member of the at least one additional cutting member in order of increasingly finer abrasive surfaces to achieve the desired shape; wherein the tapered elongate member of the at least one additional cutting apparatus has a finer abrasive surface than the first cutting apparatus.

19. The method of claim 15 further comprising:

sequentially inserting the one or more additional elongate members having increasingly less taper to achieve the desired shape; wherein the additional tapered elongate member of the at least one additional cutting apparatus tapers less than the first cutting apparatus.

20. The method of claim 15 further comprising:

inserting increasingly shorter cutting apparatuses to achieve the desired shape; wherein the additional tapered elongate member of the at least one additional cutting apparatus has a shorter length than the first cutting apparatus.

21. The method of claim 15 further comprising:

mounting the work piece on an ultrasonic device;

placing the work piece at least partially in an abrasive slurry; and agitating at least one of the work piece and the abrasive slurry with the ultrasonic device.

22. The method of claim 15 further comprising:

mounting the first cutting apparatus on an ultrasonic device;

placing the first cutting apparatus at least partially in an abrasive slurry; and agitating at least one of the first cutting apparatus and the abrasive slurry with the ultrasonic device.

23. The method of claim 15 wherein rough machining comprises using a computer numerical controlled mill.

* * * * *